US007988082B2

(12) United States Patent
Norrman et al.

(10) Patent No.: US 7,988,082 B2
(45) Date of Patent: Aug. 2, 2011

(54) BEARING FOR A SHAFT OF A GYRATORY CRUSHER AND METHOD OF ADJUSTING THE GAP WIDTH OF THE CRUSHER

(75) Inventors: Percy Norrman, Höör (SE); Jan Johansson, Arlöv (SE); Torbjörn Nilsson-Wulff, Svedala (SE); Niklas Bennstedt, Svärdsjö (SE)

(73) Assignee: Sandvik Intellectual Property AB, Sandviken (SE)

( * ) Notice: Subject to any disclaimer, the term of this patent is extended or adjusted under 35 U.S.C. 154(b) by 79 days.

(21) Appl. No.: 12/493,591

(22) Filed: Jun. 29, 2009

(65) Prior Publication Data

US 2010/0116915 A1 May 13, 2010

(30) Foreign Application Priority Data

Jul. 4, 2008 (SE) ..... 0801595

(51) Int. Cl.
*B02C 2/04* (2006.01)

(52) U.S. Cl. ..... 241/211; 241/207

(58) Field of Classification Search ..... 241/207–216
See application file for complete search history.

(56) References Cited

U.S. PATENT DOCUMENTS

| | | | | |
|---|---|---|---|---|
| 3,604,640 | A | 9/1971 | Webster | |
| 3,782,647 | A * | 1/1974 | Decker et al. | 241/215 |
| 4,016,630 | A * | 4/1977 | Bengtsson et al. | 241/207 |
| 4,060,205 | A * | 11/1977 | Pollak | 241/211 |
| 4,478,373 | A | 10/1984 | Gieschen | |
| 7,673,821 | B2 * | 3/2010 | Norrman et al. | 241/15 |

FOREIGN PATENT DOCUMENTS

WO WO 99/22869 5/1999

* cited by examiner

*Primary Examiner* — Faye Francis
(74) *Attorney, Agent, or Firm* — Drinker Biddle & Reath LLP

(57) ABSTRACT

A gyratory crusher has a crushing head fixedly attached to an upper portion of a substantially vertical shaft, on which crushing head a first crushing shell is mounted, and a frame on which a second crushing shell is mounted. The second crushing shell defines, together with the first crushing shell, a crushing gap. The gyratory crusher has a space adapted to contain liquid. The space is defined by a piston, which is formed at least partly of the lower end of the shaft, a cylinder, which is formed at least partly in an eccentric assembly, and a bottom element. The space is adapted to form a cushion with the aid of the liquid, so that the cushion can serve as a thrust bearing transmitting vertical forces from the crushing head to the bottom element.

11 Claims, 4 Drawing Sheets

BEARING FOR A SHAFT OF A GYRATORY CRUSHER AND METHOD OF ADJUSTING THE GAP WIDTH OF THE CRUSHER

CROSS-REFERENCE TO PRIOR APPLICATION

This application claims priority to Swedish Application No. 0801595-0 filed Jul. 4, 2008, which is incorporated by reference herein.

FIELD OF THE INVENTION

The present invention relates to a gyratory crusher, which includes a crushing head fixedly attached to an upper portion of a substantially vertical shaft, on which crushing head a first crushing shell is mounted, and a frame on which a second crushing shell is mounted, which second crushing shell defines, together with the first crushing shell, a crushing gap, the width of which is adjustable by changing the vertical position of the first crushing shell relative to the vertical position of the second crushing shell by way of at least one adjusting device, a driving device being arranged to rotate an eccentric assembly arranged about the lower portion of the shaft so as to cause the crushing head to perform a gyratory pendulum movement with a view to crushing material that is introduced in the crushing gap.

The present invention further relates to a method of adjusting a gap width in a gyratory crusher of the kind stated above.

BACKGROUND OF THE INVENTION

A gyratory crusher of the kind stated above can be used for crushing, for example, ore and stone material into smaller size.

WO 99/22869 discloses a gyratory crusher, in which a crushing head is mounted on a gyrating vertical shaft. At its lower end the vertical shaft is supported on a thrust bearing including three horizontal bearing plates. A first bearing plate is attached to the vertical shaft, a second bearing plate is attached to a piston arranged below the vertical shaft, and a third bearing plate is slideably and rotatably arranged between the first and second bearing plates. The first and second bearing plates are generally made of a bearing metal, such as bronze, and the third bearing plate is often made of steel. The piston arranged below the vertical shaft is included, together with a cylinder, in a hydraulic piston arrangement by way of which the vertical position of the vertical shaft can be displaced for the purpose of setting a desired crushing gap between the first and second crushing shells.

A drawback of the crusher described above is that the present type of thrust bearing is expensive to manufacture and that the horizontal bearing plates included therein are subjected to considerable wear, which necessitates frequent replacement of the thrust bearing at a high cost. Moreover, a large amount of heat is generated in the thrust bearing and this heat must be cooled off by way of oil, which in turn needs to be cooled.

OBJECTS AND SUMMARY OF THE INVENTION

It is an object of the present invention to provide a gyratory crusher in which the above drawbacks have been considerably reduced, or completely eliminated.

This object is achieved by a gyratory crusher, which includes a crushing head fixedly attached to an upper portion of a substantially vertical shaft, on which crushing head a first crushing shell is mounted, and a frame on which a second crushing shell is mounted, which second crushing shell defines, together with the first crushing shell, a crushing gap, the width of which is adjustable by changing the vertical position of the first crushing shell relative to the vertical position of the second crushing shell by way of at least one adjusting device, a driving device being arranged to rotate an eccentric assembly arranged about the lower portion of the shaft so as to cause the crushing head to perform a gyratory pendulum movement with a view to crushing material that is introduced in the crushing gap, the gyratory crusher being characterised in that it includes a space adapted to contain liquid, which space is defined by a piston, which is formed at least partly of the lower end of the shaft, a cylinder, which is formed at least partly in the eccentric assembly, and a bottom element, the space being adapted to form a cushion with the aid of the liquid, so that the cushion serves as a thrust bearing, transmitting vertical forces from the crushing head to the bottom element.

An advantage of a gyratory crusher of this kind is that the space, with the aid of the liquid, transmits forces from the crushing head and also serves as a thrust bearing. Since a liquid cushion is used as the thrust bearing, no real mechanical wear will occur during operation of the crusher. Also, the risk of causing damage to any bearing plates during mounting is eliminated. This substantially reduces the maintenance cost for the crusher. A further advantage is that the large power losses that are caused by bearing plates rubbing against each other generating frictional heat can be avoided. Thus, a gyratory crusher is provided which consumes less energy in operation than previously known crushers. Moreover, the need for cooling is reduced. The vertical shaft is generally of relatively large dimensions and therefore well adapted for use as a piston and for absorbing vertical forces from the crushing head. Since the vertical shaft serves also as a piston, a simple design requiring few parts is obtained.

According to a preferred embodiment, the space is incorporated in the adjusting device and adapted to receive a variable amount of liquid for setting of a desired vertical position of the first crushing shell. An advantage of this embodiment is that the space will serve dual functions, namely that of serving as a hydraulic thrust bearing and that of serving as an adjusting device for adjusting the vertical position of the crushing head and, thus, of the first crushing shell, since a variable amount of liquid can be supplied to the space. As such, there is no need for a separate adjusting device to enable adjusting the vertical position of the first crushing shell relative to the vertical position of the second crushing shell.

According to a preferred embodiment, the eccentric assembly is provided with at least one lug situated in the space, the lug having an underside which is exposed to the liquid and which has a first area facing downwards, and an upper side which is exposed to the liquid and which has a second area facing upwards, the first area being larger than the second area, so that the liquid will exert an upwardly directed net force on the lug and, thus, on the eccentric assembly. An advantage of this embodiment is that the liquid contained in the space will carry the whole weight or part of the weight of the eccentric assembly, which reduces the weight that needs to be carried by a bearing, such as a frame bushing, by which the eccentric assembly is carried. As a result, less heat is generated in the bearing and the wear thereof decreases, and less energy is required to rotate the eccentric assembly.

According to a preferred embodiment, the crusher is arranged for direct transmission of vertical forces, in the absence of intermediate horizontal bearing plates, from the crushing head to the frame by way of the cushion formed by the space with the aid of the liquid. An advantage of this embodiment is that expensive bearing plates can be avoided, which reduces both investment costs and maintenance costs.

Conveniently, the space is adapted to form, with the aid of the liquid, a cushion with a thickness of at least 1 cm. An advantage of this embodiment is that a thickness of about 1 cm offers a certain margin in the case of pressure surges, so that the piston does not come into contact with the cylinder bottom, which could cause undesired wear and mechanical damage to, for example, the lower end of the vertical shaft.

According to a further alternative embodiment, the vertical position of the second crushing shell relative to the frame is adjustable. As described above, it is usually preferred for the space to serve both as a hydraulic thrust bearing and as an adjusting device. In certain cases, however, it may be suitable, as an alternative to or in combination with the adjusting device, to also make use of an adjustability feature for positioning the second crushing shell relative to the frame.

According to yet another alternative embodiment, the eccentric assembly includes an eccentric and an eccentric bushing, the eccentric bushing being mountable in different rotary positions relative to the eccentric. Thus, the eccentric assembly can be adapted so as to provide, during operation, a gyratory movement which is appropriate for the type of objects to be crushed.

A further object of the present invention is to provide a simple method of adjusting a gap width, i.e., a distance between a first crushing shell and a second crushing shell, which method involves lower maintenance costs than the methods known in the art.

This object is achieved by a method of adjusting a gap width in a gyratory crusher, which includes a crushing head fixedly attached to an upper portion of a substantially vertical shaft, on which crushing head a first crushing shell is mounted, and a frame on which a second crushing shell is mounted, which second crushing shell defines, together with the first crushing shell, a crushing gap, the width of which is adjustable by changing the vertical position of the first crushing shell relative to the vertical position of the second crushing shell by way of an adjusting device, a driving device being arranged to rotate an eccentric assembly arranged about the lower portion of the shaft so as to cause the crushing head to perform a gyratory pendulum movement with a view to crushing material that is introduced in the crushing gap, which method is characterised in that liquid is supplied to a space incorporated in the adjusting device, which space is defined by a piston, which is formed at least partly of the lower end of the shaft, a cylinder, which is formed at least partly in the eccentric assembly, and a bottom element, the liquid being supplied to the space in such an amount that the desired vertical position of the first crushing shell is set, a cushion being formed by the liquid supplied to the space and serving as a thrust bearing, so that vertical forces are transmitted from the crushing head via the cushion to the frame.

An advantage of this method is that a smooth and easy adjustment of the gap width is obtained while at the same time a bearing is provided in the axial direction between the crushing head and the frame in a manner that involves low maintenance costs.

According to an even more preferred embodiment, forces are transmitted directly from the crushing head to the cushion and then to the bottom element without passing through any horizontal bearing plates. By eliminating horizontal bearing plates, investment costs, power consumption and maintenance costs associated with the crusher are reduced and a crusher of smaller height can be designed, since the bearing plates would have added to its height.

Further advantages and features of the invention will be apparent from the following description and the appended claims.

BRIEF DESCRIPTION OF THE DRAWINGS

The invention will be described below by way of embodiments and with reference to the appended drawings.

DETAILED DESCRIPTION OF THE PREFERRED EMBODIMENTS

Figure 1:
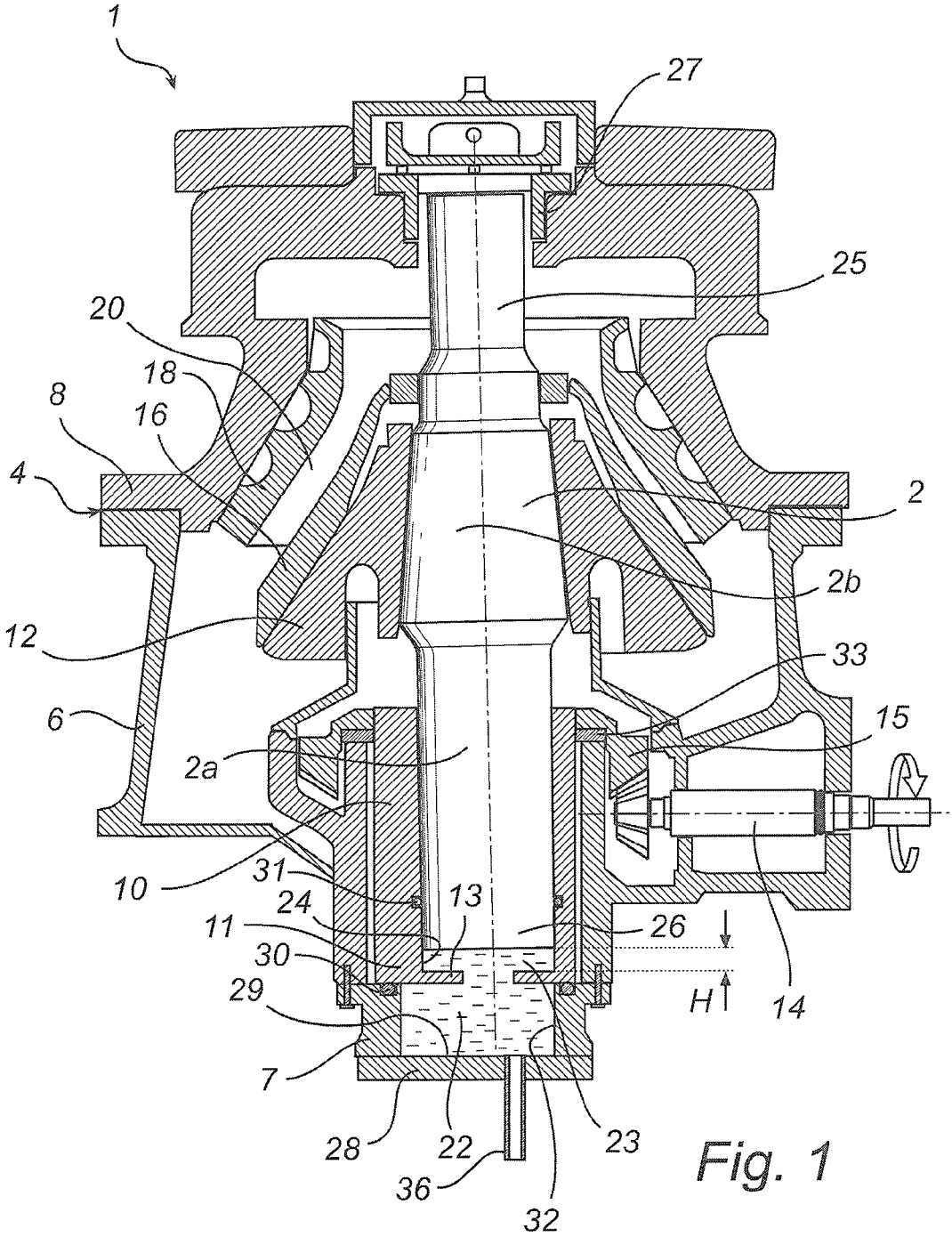
FIG. 1 is a schematic view of a gyratory crusher according to a first embodiment, in which gyratory crusher a first and a second crushing shell are located in a first position relative to each other.

FIG. 1 illustrates schematically a gyratory crusher 1 according to a first embodiment. The gyratory crusher 1 has a vertical shaft 2 and a frame 4 including a frame bottom part 6 and a frame top part 8. An eccentric assembly in the form of an eccentric 10 is rotatably arranged about the lower portion 2*a* of the shaft 2. A crushing head 12 is fixedly mounted on an upper portion 2*b* of the shaft 2. A drive shaft 14 driven by a motor (not shown) is arranged to rotate the eccentric 10 by way of a gear rim 15 mounted on the eccentric 10. The vertical shaft 2 is carried, at its upper end 25, in a top bearing 27 in the frame top part 8. As the drive shaft 14 rotates the eccentric 10 during operation of the crusher 1, the shaft 2 and the crushing head 12 mounted thereon are made to perform a gyrating movement.

A first crushing shell 16 is fixedly mounted on the crushing head 12. A second crushing shell 18 is fixedly mounted on the frame top part 8. A crushing gap 20 is formed between the two crushing shells 16, 18. Material to be crushed is introduced in the crushing gap 20 and is crushed between the first crushing shell 16 and the second crushing shell 18 as a result of the gyrating movement of the crushing head 12, during which movement the two crushing shells 16, 18 move towards each other along a rotating generatrix and move away from each other along a diametrically opposite generatrix.

The gyratory crusher 1 includes a space 22 adapted to contain a liquid, such as hydraulic oil or lubricating oil. The space 22 is defined by a cylinder 24, which is formed inside the eccentric 10, a piston, which consists mainly of the lower end 26 of the vertical shaft 2, and a bottom element 28. In this case, the bottom element 28 is formed inside the lower portion 7 of the frame bottom part 6 and includes a bottom surface 29 and a side surface 32. The piston, i.e., the lower end 26 of the shaft 2, the cylinder 24 and the bottom element 28 together form a hydraulic piston arrangement. Because the eccentric 10 will perform a rotating movement relative to the lower portion 7 of the frame bottom part 6, a sealing ring 30 has been provided. The purpose of the sealing ring 30 is thus to prevent liquid from leaking out of the space 22 between the eccentric 10 and the lower portion 7 of the frame bottom part 6. The sealing ring 30 is arranged in a groove in the lower portion 7 of the frame bottom part 6. Alternatively, the sealing ring 30 can be arranged in a groove in the eccentric 10. Moreover, an additional sealing ring 31 is arranged between the vertical shaft 2 and the eccentric 10 to prevent liquid from leaking out of the space 22 via bearings, not shown in detail, disposed between the shaft 2 and the eccentric 10. The sealing ring 31 is arranged in a groove in the eccentric 10 and thus follows the movement of the eccentric 10 during operation. Alternatively, the sealing ring 31 can be arranged in a groove in the shaft 2.

A frame bushing 33 is attached to the frame bottom part 6 adjacent the upper portion of the eccentric 10. The gear rim 15 mounted on the eccentric 10 slides on the frame bushing 33, which thus carries part of the weight of the eccentric 10 and the gear rim 15 and serves as the main thrust bearing for the eccentric 10.

The bottom element 28 is provided with a tube 36 through which liquid can be supplied to the space 22 from a supply of pressurized liquid (not shown). The space 22 is adapted to receive a certain amount of liquid and to form a liquid cushion 23 with the aid of the liquid. This cushion 23 will serve as a hydraulic thrust bearing transmitting vertically directed forces generated during crushing, from the crushing head 12 via the shaft 2 to the bottom element 28. Since the bottom element 28 is fixedly connected to the frame bottom part 6 the forces will be absorbed by the frame 4. Thus, the cushion 23 formed by the space 22 with the aid of the liquid will transmit the vertical forces produced while serving as a bearing for the gyrating rotary movement performed, during operation, by the crushing head 12 and the shaft 2 relative to the eccentric 10 and the frame 4. As a result, the horizontal bearing plates used in prior art, for example according to WO 99/22869, can be avoided.

At the lower end 11 of the eccentric 10 a catch element in the form of a stop lug 13 has been provided, the function of which is to restrict, when the crusher 1 is not in operation, the downward movement of the shaft 2 in the vertical direction. The stop lug 13 thus defines a stop position for the shaft 2. By having the shaft 2 rest on the stop lug 13, the shaft 2 can be kept in a position above the bottom element 28 also when there is no liquid in the space 22. In this way, the distance that the shaft 2 will possibly have to be displaced upwards when starting the crusher 1 can be minimized. It should be noted that in operation the shaft 2 will not enter into contact with the stop lug 13, since by then a sufficient amount of liquid will have been supplied to form a liquid cushion 23 in the space 22. During operation of the crusher 1, this liquid cushion 23 should have a thickness H of at least 1 cm. As shown in FIG. 1, the thickness H is measured from the upper face of the stop lug 13 to the lower end of the vertical shaft 2.

Figure 2:
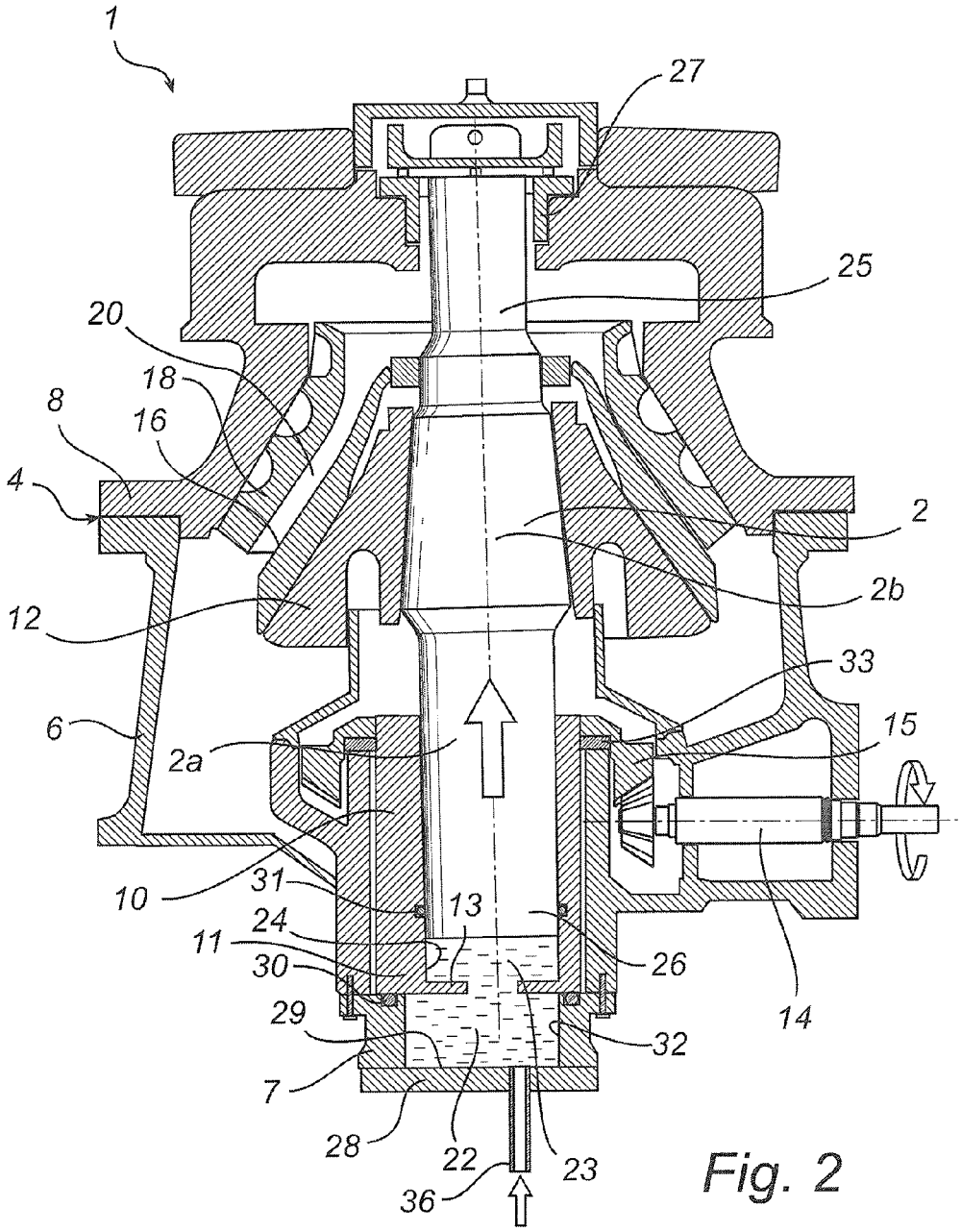
FIG. 2 is a schematic view of the gyratory crusher of FIG. 1, but in which the first and second crushing shells are located in a second position relative to each other.

FIG. 2 shows the gyratory crusher 1 in a second adjusting position. The properties of the material crushed in the gyratory crusher 1 depend largely on the width of the crushing gap 20. By changing the width of the crushing gap 20, which is done in the gyratory crusher 1 by displacing the crushing head 12 in the vertical direction, the properties of the crushed material can be manipulated. Such a vertical displacement is also used to compensate for any wear of the crushing shells 16, 18. In the gyratory crusher 1, a suitable width of the crushing gap 20 is set by supplying a variable amount of liquid to the space 22. As shown in FIG. 2, the liquid fills the space 22, thus forming the cushion 23 in the space 22. In the position shown in FIG. 2, more liquid has been supplied to the space 22 as compared with the position shown in FIG. 1, which has caused the crushing head 12 to be displaced vertically upwards relative to the frame 4, as shown in FIG. 2. As a result, the width of the crushing gap 20 has been reduced, alternatively any wear of the crushing shells 16, 18 has been compensated for. Thus, the cushion 23 formed by the space 22 with the aid of liquid is used not only as a thrust bearing, but also as a component of an adjusting device, together with the tube 36, for adjusting the vertical position of the first crushing shell 16 relative to the vertical position of the second crushing shell 18. Accordingly, the vertical distance H, shown in FIG. 1, between the lower end 26 of the shaft 2 and the lower end of the cylinder 24, as defined by the stop lug 13, will vary depending on the amount of liquid contained in the space 22. As mentioned above, this vertical distance H can be the to correspond to the current thickness of the cushion 23 formed by the space 22 with the aid of the liquid. In this case, the distance H, shown in FIG. 1, corresponds to the thickness of the cushion 23 formed by the space 22 with the aid of the liquid between the lower end 26 of the shaft 2 and the stop lug 13. To ensure a satisfactory thrust bearing function, the thickness of the cushion 23 should, according to the above, be at least 1 cm when the crushing head 12 is in its lowermost position.

Figure 3:
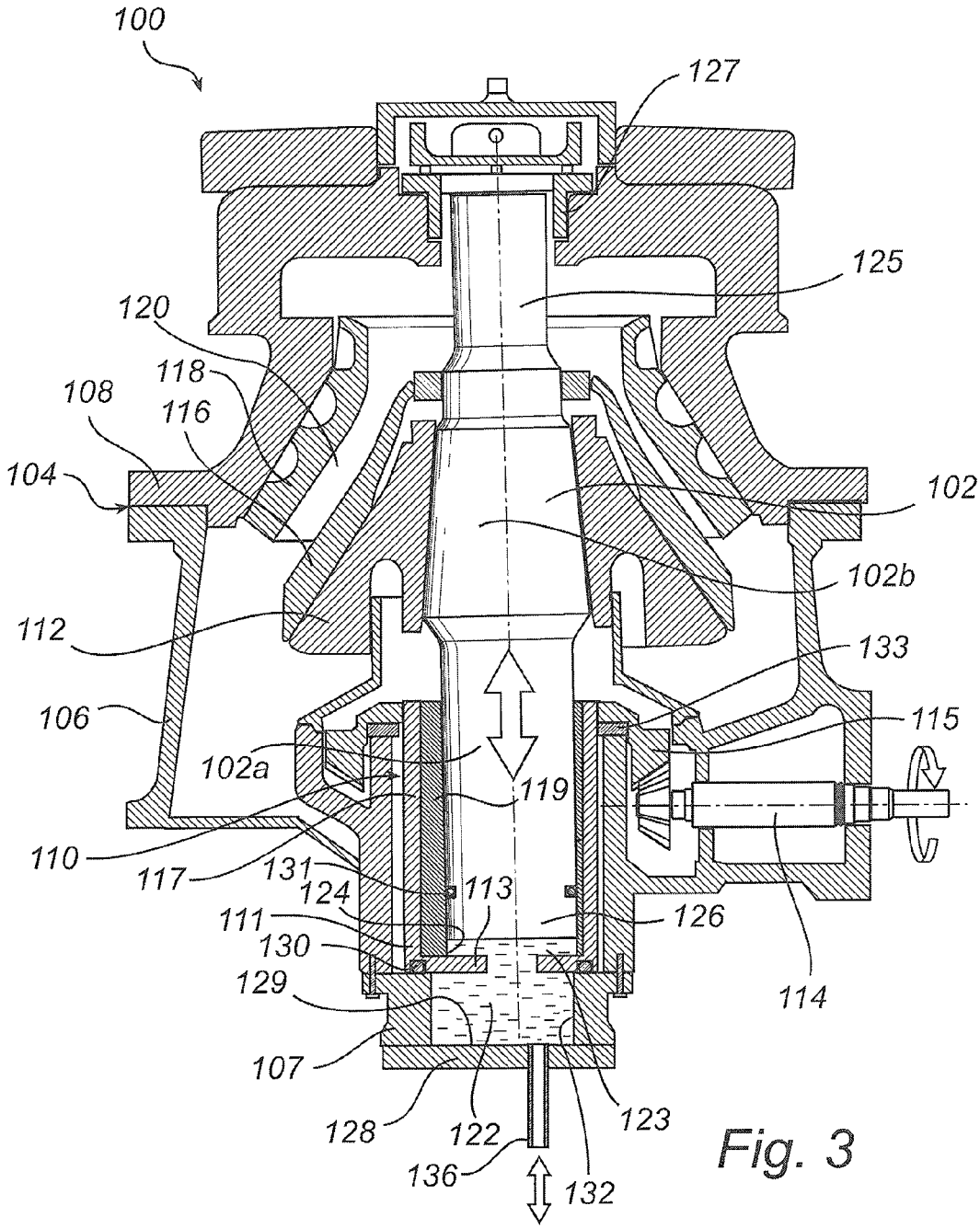
FIG. 3 is a schematic view of a gyratory crusher according to a second embodiment.

FIG. 3 illustrates schematically a gyratory crusher 100 according to an alternative embodiment. The gyratory crusher 100 has a vertical shaft 102 and a frame 104 including a frame bottom part 106 and a frame top part 108. An eccentric assembly 110 is rotatably arranged about the lower portion 102*a* of the shaft 102. The eccentric assembly 110 includes an eccentric 117 and an off-centre eccentric bushing 119 mounted in the eccentric 117. A crushing head 112 is fixedly mounted on an upper portion 102*b* of the shaft 102. A drive shaft 114 driven by a motor (not shown) is arranged to rotate the eccentric assembly 110 by way of a gear rim 115 mounted on the eccentric assembly 110. The vertical shaft 102 is carried, at its upper end 125, in a top bearing 127 in the frame top part 108. As the drive shaft 114 rotates the eccentric assembly 110, during operation of the crusher 100, the shaft 102 and the crushing head 112 mounted thereon are made to perform a gyrating movement.

A first crushing shell 116 is fixedly mounted on the crushing head 112. A second crushing shell 118 is fixedly mounted on the frame top part 108. Between the two crushing shells 116, 118 a crushing gap 120 is formed, whose function is similar to that of the crushing gap 20 described with reference to FIG. 1.

The gyratory crusher 100 includes a space 122 adapted to contain a liquid, such as hydraulic oil or lubricating oil. The space 122 is defined by a cylinder 124, which is formed inside the eccentric bushing 119 forming part of the eccentric assembly 110, a piston, which consists mainly of the lower end 126 of the vertical shaft 102, and a bottom element 128. In this case, the bottom element 128 is formed inside the lower portion 107 of the frame bottom part 106 and includes a bottom surface 129 and a side surface 132. The piston, i.e., the lower end 126 of the shaft 102, the cylinder 124, and the bottom element 128 together form a hydraulic piston arrangement. Because the eccentric 117 will perform a rotary movement relative to the lower portion 107 of the frame bottom part 106, a sealing ring 130 has been provided, the purpose of which is to prevent liquid from leaking out of the space 122 between the eccentric 117 and the lower portion 107 of the frame bottom part 106. The sealing ring 130 is arranged in a groove in the eccentric 117 and thus follows the movement of the eccentric 117 during operation. A sealing ring 131 is arranged between the vertical shaft 102 and the eccentric bushing 119 included in the eccentric assembly 110 to prevent liquid from leaking out of the space 122 via bearings, not shown in detail, disposed between the shaft 102 and the eccentric bushing 119. The sealing ring 131 is arranged in a groove in the circumference of the shaft 102 and thus follows the vertical movement of the shaft 102 during adjusting of the vertical position of the crushing head 112 and, thus, of the first crushing shell 116.

The position of the eccentric bushing 119 relative to the eccentric 117 determines how much the shaft 102 will gyrate during the rotation of the eccentric 117. The eccentric bushing 119 can be mounted in different rotary positions relative to the eccentric 117 to enable setting of the amount of gyration to be performed by the shaft 102 during operation. This is called to adjust the crusher stroke, since the rotary position of the off-centre eccentric bushing 119 with respect to the rotary position of the likewise off-centre eccentric 117 determines to what extent the geometrical axis of the shaft 102 will deviate from the vertical plane during operation of the crusher. By adjusting the rotary position of the eccentric bushing 119 with respect to the eccentric 117, when the crusher 100 is not in operation, the eccentric assembly 110 can be adapted to provide a gyrating movement, during operation, which is appropriate for the type of objects to be crushed in the crusher 100.

The bottom element 128 is provided with a tube 136 through which liquid can be supplied to the space 122 from a supply of pressurized liquid (not shown). The space 122 is adapted to receive a certain amount of liquid and to form a liquid cushion 123 with the aid of the liquid. This cushion 123 will serve as a hydraulic thrust bearing transmitting vertically directed forces generated during crushing from the crushing head 112 via the shaft 102 to the bottom element 128, in a manner similar to that described above with respect to the bottom element 28 and with reference to FIG. 1.

At the lower end 111 of the eccentric 117 a catch element in the form of a stop lug 113 has been provided, the function of which is, when the crusher is not in operation, to restrict the downward movement of the shaft 102 in the vertical direction. Thus, the stop lug 113 defines a stop position for the shaft 102, in a manner similar to that described above with respect to the stop lug 13 shown in FIG. 1. It should be noted that, during operation, the shaft 102 will not come into contact with the stop lug 113, since by then a sufficient amount of liquid will have been supplied to form a liquid cushion 123 in the space 122.

A frame bushing 133 is attached to the frame bottom part 106 adjacent the upper portion of the eccentric assembly 110. The gear rim 115 mounted on the eccentric assembly 110 slides on the frame bushing 133, which thus carries part of the weight of the eccentric assembly 110 and the gear rim 115 and serves as the main thrust bearing for the eccentric assembly 110.

Adjustment of the vertical position of the crushing head 112 and, thus, of the first crushing shell 116 can be carried out according to essentially the same principles as described above with reference to FIG. 2. Accordingly, liquid is supplied to the space 122 via the tube 136 in such an amount that the shaft 102, and thereby the crushing head 112 and the crushing shell 116 mounted thereon, obtain a desired vertical position, as indicated by two-way arrows in FIG. 3.

Figure 4:
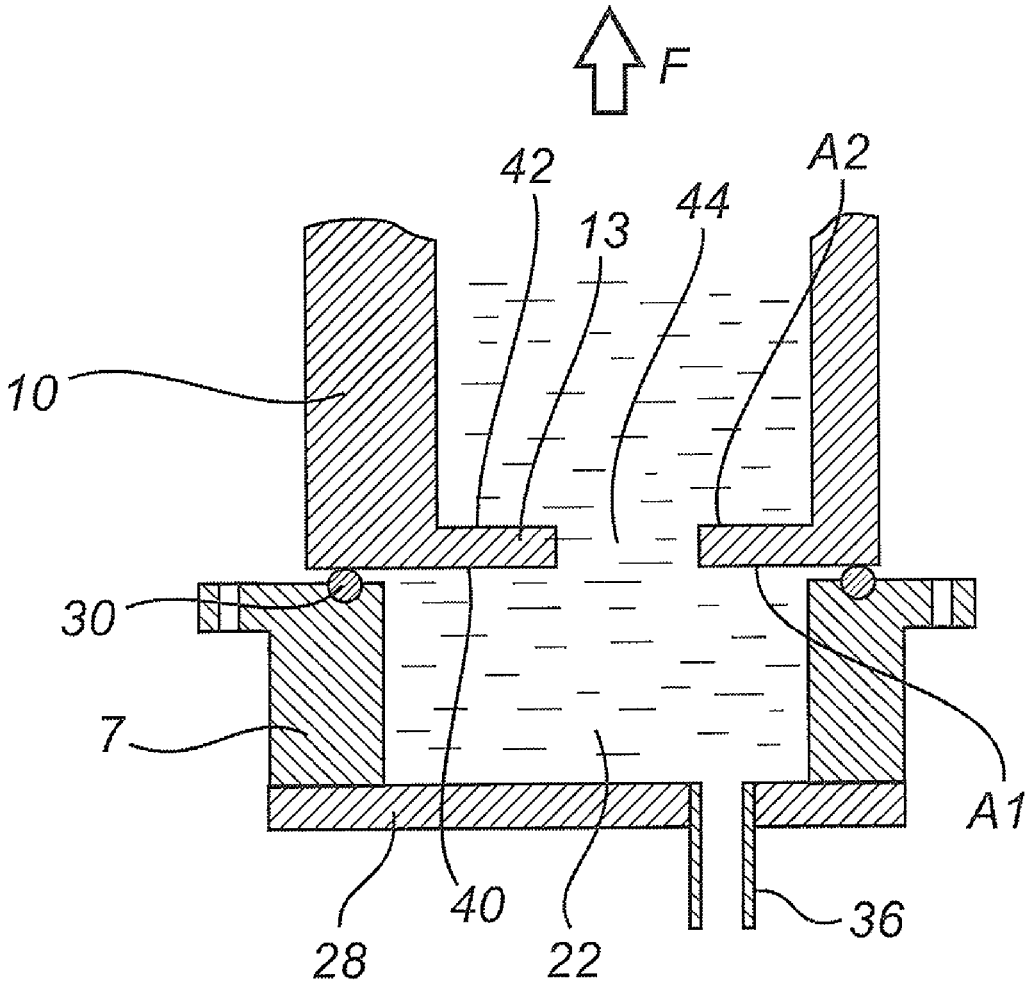
FIG. 4 is a schematic, enlarged view of the lower portion of the gyratory crusher shown in FIG. 1.

FIG. 4 shows, in a scaled-up schematic view, the lower portion of the gyratory crusher shown in FIG. 1 and FIG. 2. The stop lug 13 has been designed with an underside 40 which is exposed to the liquid in the space 22 and which has a first area A1 facing downwards. The stop lug 13 has further been designed with an upper side 42 which is exposed to the liquid in the space 22 and which has a second area A2 facing upwards. The lower portion 7 of the frame bottom part 6 and the eccentric 10 have been designed with respect to the stop lug 13 such that the first area A1 is larger than the second area A2, i.e., A1>A2. The areas A1 and A2 are both subjected to pressure from the liquid in the space 22. Owing to an opening 44 in the stop lug 13, the pressure exerted by the liquid is the same in the whole space 22, i.e., the pressure acting on the first area A1 is the same as the pressure acting on the second area A2. The vertical force exerted on the stop lug 13 by the liquid in the space 22 is given by the product of the pressure and the area. Thus, at a pressure P in the liquid the force F1 which pushes the stop lug 13 upwards is given by F1=A1*P. The force F2 which pushes the stop lug 13 downwards is given by F2=A2*P. Since A1>A2, F1 will be greater than F2, i.e., the stop lug 13 will be subjected to an upwardly directed net force F which equals F1 minus F2. Thus, the net force F will lift some of the weight of the eccentric 10 and the gear rim 15, and will reduce the load on the frame bushing 33 shown with reference to FIG. 1 and FIG. 2. This load reduction on the frame bushing 33 will result in reduced heat generation when the gear rim 15 is sliding on the frame bushing 33 as well as reduced wear. Thus, the liquid contained in the space 22 carries not only the weight of the shaft 2 shown in FIG. 1 and FIG. 2, but also part of the weight of the eccentric 10 and the gear rim 15. It will be appreciated that the exact design of the two areas A1, A2 of the stop lug 13 determines how much of the weight of the eccentric 10 and the gear rim 15 will be carried by the liquid contained in the space 22. It is often appropriate to have the liquid contained in the space 22 carry slightly less than the whole weight of the eccentric 10 and the gear rim 15, so that the gear rim 15 exerts a certain pressure on the frame bushing 33. Therefore, the areas A1 and A2 are dimensioned with respect to the liquid pressure in the space 22 to obtain the desired magnitude of the upwardly directed force F.

The sealing ring 30 shown in FIG. 4 will be subjected to a limited pressure from the eccentric 10, and will serve primarily as a seal and only to a limited degree as a bearing between the eccentric 10 and the lower portion 7. This is illustrated in FIG. 4 by a gap between the eccentric 10 and the lower portion 7. As a result, the wear of the sealing ring 30 will be small.

It will be appreciated that various modifications of the embodiments described above are conceivable within the scope of the invention, as defined by the appended claims.

It has been described above that the liquid supplied to the space 22 is hydraulic oil or lubricating oil. It will be appreciated that other types of liquid that are suitable for hydraulic piston arrangements can be used. For instance, different types of hydraulic liquids, different types of oils, etc. may be supplied to the space 22. It may also be possible to use other types of liquids, such as water-containing liquids.

It has been illustrated above that the space 22 is used for two functions: as a hydraulic thrust bearing and as part of an adjusting device for adjusting the vertical position of the crushing head 12. It is also possible to use the space 22 as a hydraulic thrust bearing only. In this case, the vertical position of a first crushing shell relative to the vertical position of a second crushing shell can be changed by way of some other device. For example, the position of the second crushing shell relative to the frame top part can be adjusted. In this case, use can be made of devices known per se, in which the vertical position of the second crushing shell is adjusted by way of a sleeve with a trapezoidal thread that is rotated relative to the frame top part, see for example FIG. 1 of U.S. Pat. No. 4,478,373, or by way of a hydraulically adjustable frame top part, see for example FIG. 1 of U.S. Pat. No. 3,604,640. It is normally preferred, however, to combine the hydraulic thrust bearing function of the cushion 23 with the vertical adjusting function as described above with reference to FIG. 1 and FIG. 2.

It has been described above with reference to FIG. 4 how the stop lug 13 on which the shaft 2 is able to rest when the liquid has been evacuated from the space 22 also serves as a lug by way of which the liquid in the space 22 is able to carry part of the weight of the eccentric 10 and the gear rim 15. It will be appreciated that it is also possible to design a gyratory crusher with two or more lugs, where one lug is adapted to serve as a stop lug, and another lug is adapted to help the liquid in the space 22 to carry part of the weight of the eccentric 10. In this case, a separate stop lug, for example, which only serves as a support for the shaft 2, can be disposed some distance above the lower portion of the eccentric 10, i.e., above the lug 13 shown in FIG. 4, if appropriate.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A gyratory crusher, comprising:

a crushing head fixedly attached to an upper portion of a substantially vertical shaft, on which crushing head a first crushing shell is mounted;

a frame on which a second crushing shell is mounted, said second crushing shell and said first crushing shell defining a crushing gap therebetween;

at least one adjusting device for adjusting the width of said crushing gap by changing a vertical position of the first crushing shell relative to a vertical position of the second crushing shell; and a driving device being arranged to rotate an eccentric assembly arranged about the lower portion of the shaft so as to cause the crushing head to perform a gyratory pendulum movement for crushing material that is introduced in the crushing gap, wherein the gyratory crusher comprises a space adapted to contain liquid, which space is defined by a piston, which is formed at least partly of the lower end of the shaft, a cylinder, which is formed at least partly in the eccentric assembly, and a bottom element, said space being adapted to form a cushion with the aid of said liquid, so that said cushion serves as a thrust bearing transmitting vertical forces from the crushing head to the bottom element.

2. The gyratory crusher according to claim 1, wherein said space is incorporated in said adjusting device and adapted to receive a variable amount of liquid for setting of a desired vertical position of the first crushing shell.

3. The gyratory crusher according to claim 1, wherein the eccentric assembly is provided with at least one lug situated in said space, the lug having an underside which is exposed to the liquid and which has a first area facing downwards, and an upper side which is exposed to the liquid and which has a second area facing upwards, the first area being larger than the second area, so that the liquid will exert an upwardly directed net force on the lug and, thus, on the eccentric assembly.

4. The gyratory crusher according to claim 1, wherein said space is adapted to form, with the aid of the liquid, a cushion with a thickness of at least 1 cm.

5. The gyratory crusher according to claim 1, wherein said eccentric assembly comprises an eccentric and an eccentric bushing, the eccentric bushing being mountable in different rotary positions relative to the eccentric.

6. The gyratory crusher according claim 1, wherein the eccentric assembly is provided with at least one stop lug, on which the shaft is able to rest when the liquid has been evacuated from the space.

7. The gyratory crusher according to claim 1, wherein said gyratory crusher is arranged for direct transmission of vertical forces, in the absence of intermediate horizontal bearing plates, from the crushing head to the bottom element by way of the cushion formed by the space with the aid of the liquid.

8. A method of adjusting a gap width in a gyratory crusher, comprising:

providing a crushing head fixedly attached to an upper portion of a substantially vertical shaft, on which crushing head a first crushing shell is mounted, and a frame on which a second crushing shell is mounted, which second crushing shell defines, together with the first crushing shell, a crushing gap, the width of said crushing gap being adjustable by changing a vertical position of the first crushing shell relative to a vertical position of the second crushing shell by way of an adjusting device, a driving device being arranged to rotate an eccentric assembly arranged about the lower portion of the shaft so as to cause the crushing head to perform a gyratory pendulum movement for crushing material that is introduced in the crushing gap;

supplying liquid to a space incorporated in said adjusting device, which space is defined by a piston, which is formed at least partly of the lower end of the shaft, a cylinder, which is formed at least partly in the eccentric assembly, and a bottom element, the liquid being supplied to the space in such an amount that the desired vertical position of the first crushing shell is set, a cushion being formed by the liquid supplied to said space and serving as a thrust bearing, so that vertical forces are transmitted from the crushing head via the cushion to the bottom element.

9. The method according to claim 8, wherein the eccentric assembly is provided with at least one lug, situated in said space, the lug having an underside which is exposed to the liquid and which has a first area facing downwards, and an upper side which is exposed to the liquid and which has a second area facing upwards, the first area being larger than the second area and the first and second areas being subjected to the same liquid pressure, so that the liquid will exert an upwardly directed net force on the lug and, thus, on the eccentric assembly.

10. The method according to claim 8, wherein vertical forces are transmitted directly from the vertical shaft to the cushion and then to the bottom element without passing through any horizontal bearing plates.

11. A gyratory crusher, comprising:

a crushing head fixedly attached to an upper portion of a substantially vertical shaft, on which crushing head a first crushing shell is mounted;

a frame on which a second crushing shell is mounted, said second crushing shell and said first crushing shell defining a crushing gap therebetween;

a driving device being arranged to rotate an eccentric assembly arranged about the lower portion of the shaft so as to cause the crushing head to perform a gyratory pendulum movement for crushing material that is introduced in the crushing gap; and an adjusting device for adjusting the width of said crushing gap by changing a vertical position of the first crushing shell relative to a vertical position of the second crushing shell, the adjusting device including a space adapted to contain liquid, which space is defined by a piston, a cylinder, and a bottom element, the piston being formed at least partly of the lower end of the shaft, the cylinder being formed at least partly in the eccentric assembly;

wherein when said space is filled with liquid, the liquid forms a cushion that serves as a thrust bearing transmitting vertical forces from the crushing head to the bottom element; and wherein the adjusting device adjusts the width of said crushing gap based on the amount of liquid in the space.

* * * * *